US006464565B1

(12) United States Patent
Audet

(10) Patent No.: US 6,464,565 B1
(45) Date of Patent: Oct. 15, 2002

(54) METHOD OF POLISHING STERLING SILVER AND GOLD PIECES

(76) Inventor: Edward A. Audet, 198 Trout Brook La., Scituate, RI (US) 02831

( * ) Notice: Subject to any disclaimer, the term of this patent is extended or adjusted under 35 U.S.C. 154(b) by 46 days.

(21) Appl. No.: 09/829,173

(22) Filed: Apr. 9, 2001

(51) Int. Cl.[7] ..... B24B 1/04; B24B 31/00

(52) U.S. Cl. ..... 451/29; 451/35; 451/41; 451/326; 451/330

(58) Field of Search ..... 451/29, 30, 32, 451/35, 41, 54, 326, 328, 330

(56) References Cited

U.S. PATENT DOCUMENTS 1,678,359 A * 7/1928 Schulte ..... 451/35
2,185,262 A * 1/1940 Lupo, Jr. ..... 451/35
3,680,266 A * 8/1972 Shiplov ..... 366/112
5,669,978 A * 9/1997 Brown ..... 134/1
5,713,895 A * 2/1998 Lontine et al. ..... 606/41

* cited by examiner

*Primary Examiner*—M. Rachuba
(74) *Attorney, Agent, or Firm*—Barlow, Josephs & Holmes, Ltd.

(57) ABSTRACT

The present invention provides a new and improved method for differentially polishing the surface of metallic materials in a dry tumbling operation. The process involves providing a finish of a first type on a metallic object. A protective coating is then placed over the first area. The object is then placed into a tumbling drum with a dry polishing media and tumbled to provide a polished finish on the unprotected surface. A secondary feature of the present invention provides the ability to flash off the polishing compounds between polishing batches to prevent build up of polishing residue and provide more consistent results.

14 Claims, 2 Drawing Sheets

METHOD OF POLISHING STERLING SILVER AND GOLD PIECES

BACKGROUND OF THE INVENTION

The present invention relates to an improved method for finishing the surfaces of metallic objects. More particularly, the present invention provides an improved dry processing method for tumbling metallic objects to provide a smoothly polished finished surface while providing protection to recessed areas of the object that are not intended to be polished.

Presently, to provide a polished finished on a relatively small object, two processes are available, a dry process and a wet process. The "wet" process involves placing abrasive polishing media and a mixture of turpentine and naphtha into a tumbling drum and adding the objects to be polished. The drawback to this wet process is the quantity of waste tumbling media and volatile chemicals that remain after the process is completed. These hazardous materials must be properly disposed of after use. In addition, the entire surface of the object must receive the same level of finish.

In the "dry" tumbling process, hard pellets, such as hard wood pegs, are first prepared by coating them with a variety of oils, waxes, abrasive agents and adhesives. The pellets are then loaded into the tumbling drum and then the objects to be finished are added. The tumbling action generates friction and heat that allows some of the waxes and oils to soften and act as a lubricant for the tumbling of the objects. The friction of the objects and the pellets colliding in the tumbling action in effect polishes the surface of the finished objects while generally being gentle enough not to damage the objects. The advantage to this process is the elimination of the wet material that must be disposed of as hazardous waste. However, differential surface finishes still cannot be provided.

The drawback with the present state of the art is that objects finished in both the "wet" and "dry" manner must have a uniform finish across the entire surface due to the impact and rubbing friction involved. Objects that have differentiated surfaces such as recesses, or objects that are desired to have a different finish on part of their surface must be entirely finished by hand. For example, a ring or bracelet that has a recessed design with a frosted finish on the recessed surfaces and a polished finish on the raised surfaces cannot be tumbled, but must first be sandblasted to texture the recessed surfaces and then hand polished on a buffing wheel to shine the raised surfaces. This process requires a great deal more labor and cost to provide the desired finished objects.

Another drawback to the tumbling process is that over time, the process becomes inconsistent and requires extended tumbling times to achieve a polished finish. This is a result of the build up of waxes and oils on the tumbling media as the tumbling media is reused.

In view of the foregoing, there is a demand for an automated polishing method that can handle a large number of objects to be polished in bulk. There is a demand for a dry bulk process by which objects that have differentiated surfaces can be polished while allowing an earlier applied finish to remain on selected areas of the surface. In addition, there is a demand for a dry bulk polishing system that provides a consistent finish while providing for reuse of the tumbling media.

SUMMARY OF THE INVENTION

In this regard, the instant invention provides an improved method of polishing metallic objects that allows differential finishes to be provided on the surface of the object while providing a bulk finishing operation. In particular, this method has application in the jewelry finishing field as often different finishes such as sandblasting, brushing or polishing are used in combination to achieve the desired appearance on the finished piece. By way of example, the present invention will be illustrated as applied to fine gold or sterling silver jewelry and in particular a bracelet, although the application and scope of the present invention is not limited by this illustration.

The present invention is employed to provide a differential surface finish on cast metallic items such as jewelry. Once the item is removed from the casting mold the first finish is applied on the recessed surfaces of the object. To overcome the drawback of the prior art and to protect the first finish a protective barrier is applied over the entire piece. The protective barrier consists of a water-soluble stop-off material. The piece is then buffed by hand, removing the stop-off material from the raised surfaces of the piece but leaving a protective barrier over the finish applied in the recessed areas.

Once several pieces are prepared as described above, they are loaded into a tumbling drum with a tumbling media and a high VOC dry tumbling compound. The parts are tumbled and the friction generated with the tumbling media polishes the exposed surfaces of the objects, while the recessed surfaces remain protected beneath the stop-off material. The tumbled pieces are then removed from the drum for final cleaning and finishing, and the tumbling media within the drum is cleaned for reuse in subsequent tumbling operations in accordance with the present invention. In particular, the media is cleaned by rotating the drum at a high rotational speed to cause the more volatile polishing compounds to "flash off", taking with them the heavier polishing materials and leaving the tumbling media clean for the next batch of objects.

The tumbled jewelry pieces are cleaned using an ultrasonic water spray to break down and remove the water-soluble stop-off material, exposing the textured finish on the recessed surfaces. The pieces are then lightly buffed by hand and prepared for shipment.

Accordingly, among the objects of the instant invention are: the provision of an efficient bulk process for imparting a differential finish to a metallic object; the provision of a dry polishing process capable of providing a differential finish; the provision of a dry polishing process that also provides for reuse and conservation of the tumbling media while producing consistent results.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
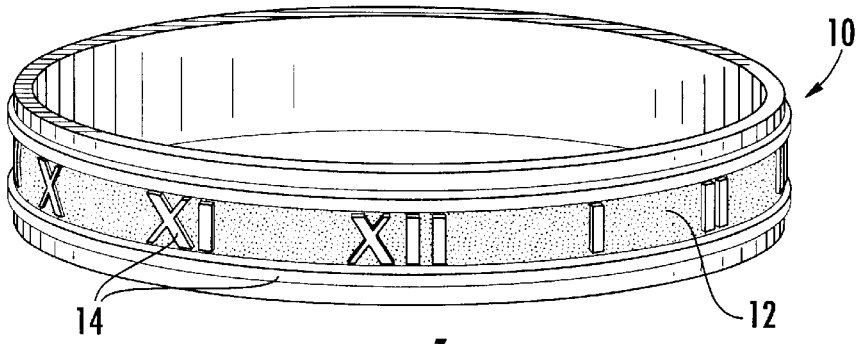
FIG. 1 is a perspective view of an object to be polished using the method of the present invention.
Figure 2:
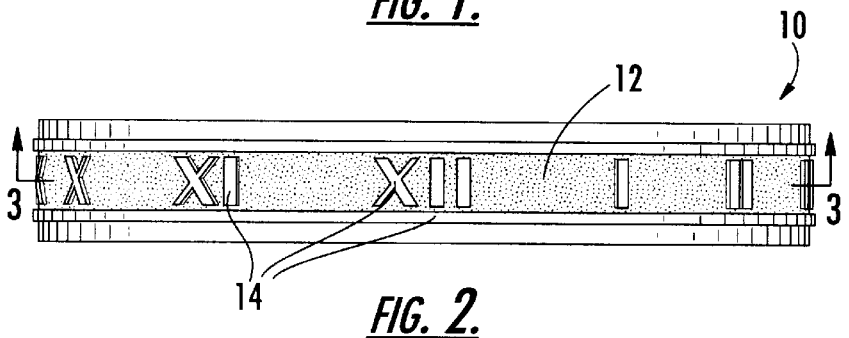
FIG. 2 is a side view thereof.
Figure 3:
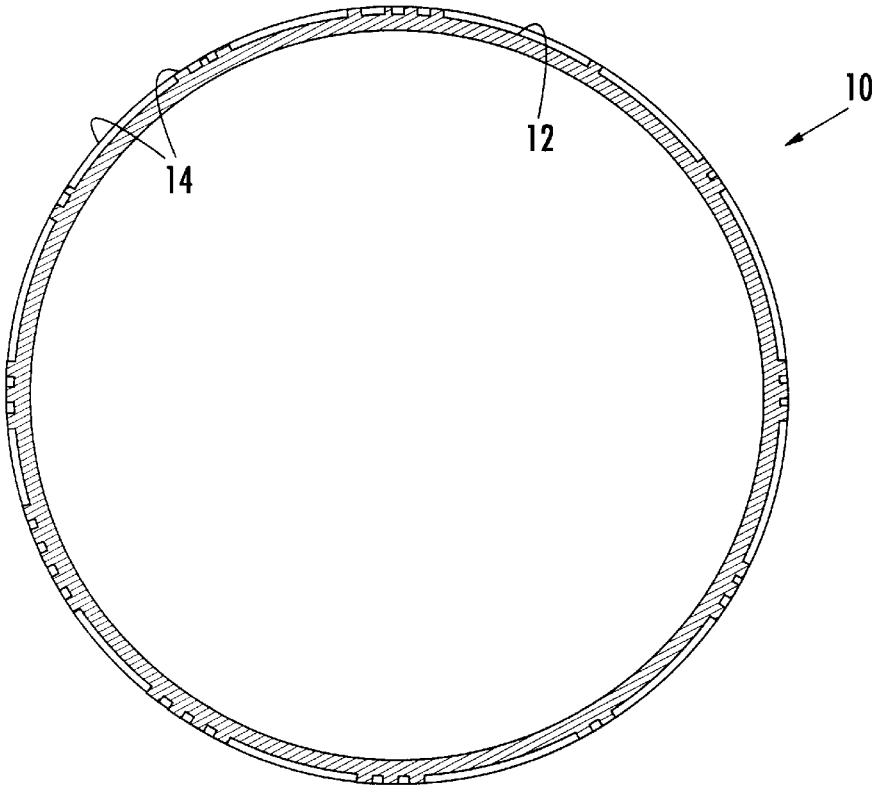
FIG. 3 is a cross-sectional view thereof as taken along line 3—3 of FIG. 2.
Figure 4:
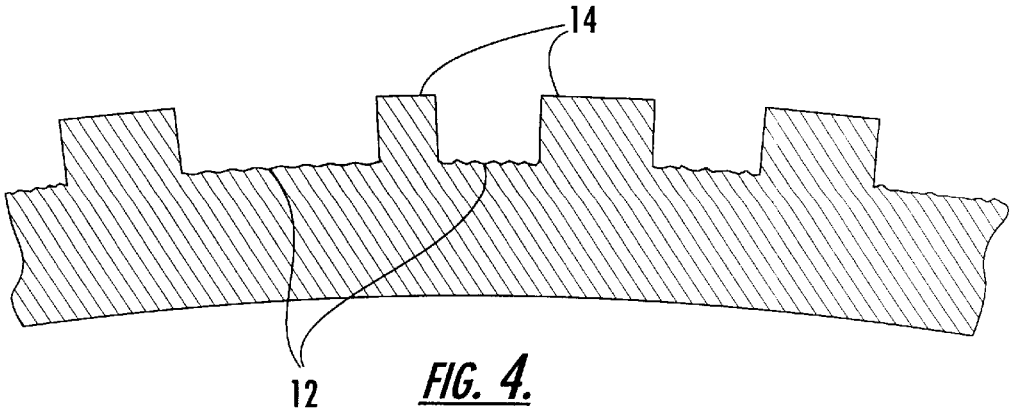
FIG. 4 is an exploded detail view of the cross-sectional view of FIG. 3.

Referring now to the drawings, a metallic object, shown here as a bracelet for illustration purposes, prepared and polished in accordance with the instant invention is illustrated and generally indicated at 10 in FIGS. 1–6. As will hereinafter be more fully described, the instant invention utilizes a conventional tumble polishing process with a modified polishing compound and protective film coating to produce a finished bracelet 10 with a differentially finished surface.

Turning first to FIG. 1, a bracelet is shown having recessed surfaces 12 with a generally textured surface finish and raised surfaces 14 having a polished finish. As can be seen, the recessed surface 12 can have a textured finish that is achieved through sandblasting, carving or brushing as is desired for esthetic purposes. The raised surfaces 14 provide ornamentation such as the numerals shown in this bracelet and the raised bands bordering the edges of the bracelet 10. The raised surfaces 14 are those that are polished in the present invention.

Figure 5:
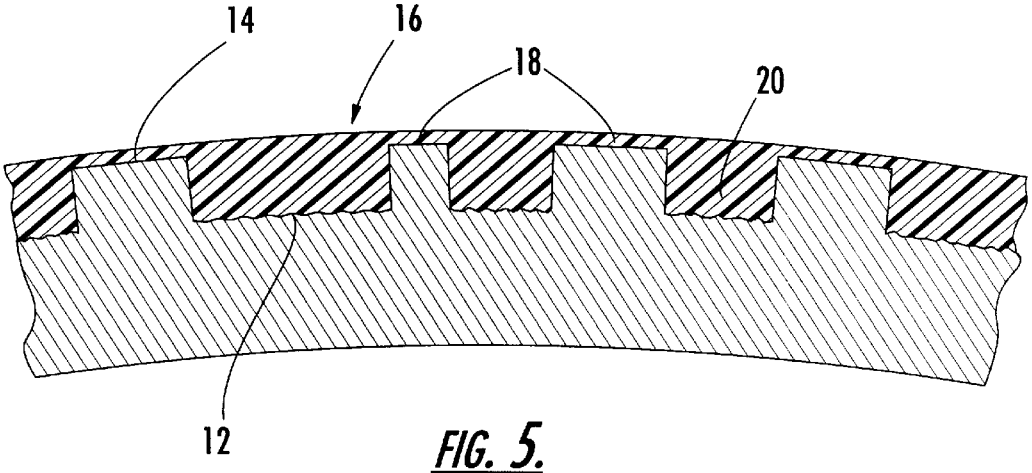
FIG. 5 is an exploded detail view of the cross-sectional view of FIG. 3 showing the protective barrier installed.
Figure 6:
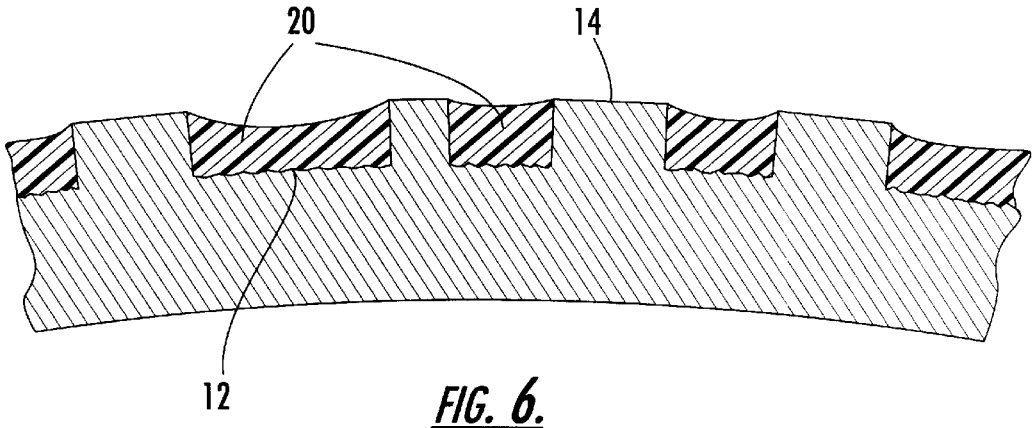
FIG. 6 is an exploded detail view of the cross-sectional view of FIG. 3 with a portion of the protective barrier removed to expose the raised surfaces.

Turning to FIGS. 3–6, the process of the present invention begins with a rough cast metallic object 10. Metal pieces formed by processes other than casting can also be processed in accordance with the present invention. The desired finish is applied to the recessed surfaces 12 either through sandblasting, or any other desired method. In order to provide the differential finish as described above a means of protecting the finished, recessed surfaces 12 is required. Turning to FIG. 5, the present invention provides for a water-soluble stop-off material 16 such as ochre to be applied over the entire raised 14 and recessed 12 surface of the bracelet 10 as a means for protecting the previously finished recessed areas 12. As can be seen, the stop-off material located over the raised areas 18 must then be removed from the raised surfaces 14 which are to receive a polished finish. As seen in FIG. 6, the stop-off material 16 is removed from the raised areas 14 by buffing the bracelet 10. This preliminary buffing step exposes the raised areas for the subsequent polishing step, while leaving a covering of stop-off material 20 in the recessed areas 12 as protection for the previously completed finish.

Prior to introducing the bracelet 10 into a tumbling drum (not shown), a tumbling hardwood media is prepared by coating it with a polishing compound consisting of a non water-soluble mixture of RX3 turpentine cream, baby oil and paint thinner.

In the preferred method, the hardwood tumbling media comprises a mixture of pegs and cubes. However, it should be understood that other hardwood pieces might also be used. It should also be understood that other tumbling medias such as pumice or sawdust could also be used.

The polishing compound is absorbed by the hardwood tumbling media and provides lubrication between the tumbling media and the bracelet 10 to facilitate the polishing action. The key aspect of the invention is preserving the stop-off material in an intact condition during the entire tumbling process to protect the underlying finish. In this regard, the use of a non water-soluble polishing compound is critical to proper practice of the inventive method. The non water-soluble nature of the polishing compound prevents it from reacting with the stop-off material 16 on the bracelet 10, leaving the stop-off intact to protect the previously applied finish.

The cast bracelet 10 and the coated tumbling media are introduced to the tumbling drum and tumbled for a period of time to produce the desired polished finish on the exposed raised surfaces 14. Since the process of the present invention is a dry process, after tumbling there is no residue remaining on the bracelet 10 and it can be removed from the tumbling media for final finishing.

Once the bracelet 10 is removed from the tumbling drum, the tumbling drum, still containing the tumbling media, is rotated at a high rate of speed. This step in the process allows the highly volatile paint thinner to flash off and thus clean the tumbling media. The lighter paint thinner serves as a carrier for the heavier compounds to remove the heavier turpentine and oil components from the tumbling media. This cleaning step provides an extended life of the media and enhances the consistency of the process from batch to batch by allowing the process to start with a relatively clean tumbling media.

After being removed from the tumbling drum, the bracelet 10 is cleaned with an ultrasonic water spray to remove the stop-off material 20 from the recessed areas 12 and exposes the pre-finished surfaces. The bracelet 10 is then buffed by hand to provide a high quality finished product and is then prepared for shipping.

It can therefore be seen that the process of the present invention produces a differentially finished product that has both textured surfaces and machine produced polished surfaces. As compared with the prior art, the present method is believed to be highly efficient in terms of both labor required and byproduct produced. The ability to provide a polished finish in a tumbling process while preserving the pre-applied textured finish provides a clear reduction in required labor over the prior art processes. The ability to clean and reuse the tumbling media for subsequent polishing processes reduces the amount of media required while reducing the byproduct generated. Further still, cleaning and reusing the tumbling media provides a level of consistency from polishing batch to polishing batch. For these reasons, the instant invention is believed to represent a significant advancement in the art, which has substantial commercial merit.

While there is shown and described herein certain specific structure embodying the invention, it will be manifest to those skilled in the art that various modifications and rearrangements of the objects may be made without departing from the spirit and scope of the underlying inventive concept and that the same is not limited to the particular forms herein shown and described except insofar as indicated by the scope of the appended claims.

What is claimed is:

1. A method of polishing metallic objects in a tumbling process, said objects having a first raised surface and a second surface recessed from said first surface, said second surface having a textured finish, said method comprising the steps of:

applying a water-soluble barrier over said second surface of the object;

tumbling said objects in a tumbling drum containing a tumbling media coated with a dry polishing compound, whereby said tumbling polishes said first raised surface of said objects;

removing said objects from said tumbling drum; and removing said water soluble barrier from said second surface of said objects.

2. The method of claim 1, further comprising the step of cleaning said tumbling media by rotating said tumbling drum at a high rotational speed.

3. The method of claim 1, further comprising the step of buffing said raised surface of said object to remove said water-soluble barrier from said first raised surface after the step of applying said water-soluble barrier.

4. The method of claim 1, wherein, said tumbling media comprises hardwood pegs and cubes.

5. The method of claim 1, wherein, said coating on said tumbling media comprises a coating of RX3 turpentine cream, baby oil and paint thinner.

6. The method of claim 1, wherein, said step of applying a water-soluble barrier comprises applying an Ochre stop-off material.

7. The method of claim 1, wherein, said water-soluble barrier is removed by an ultrasonic water spray.

8. A method of polishing metallic objects, said objects having a first raised surface and a second surface recessed from said first surface, said second surface having a first finish, said method comprising the steps of:

applying a barrier over said second surface of the object;

tumbling said objects in a tumbling drum containing a tumbling media coated with a polishing solution, whereby said tumbling polishes said first raised surface of said objects;

removing said objects from said tumbling drum; and removing said barrier from said second surface of said objects.

9. The method of claim 8, further comprising the step of cleaning said tumbling media by rotating said tumbling drum at a high rotational speed.

10. The method of claim 8, further comprising the step of buffing said raised surface of said object to remove said water-soluble barrier from said first raised surface after the step of applying said water-soluble barrier.

11. The method of claim 8, wherein, said tumbling media comprises hardwood pegs and cubes.

12. The method of claim 8, wherein, said coating on said tumbling media comprises a coating of RX3 turpentine cream, baby oil and paint thinner.

13. The method of claim 8, wherein, said barrier comprises a water-soluble Ochre stop-off material.

14. The method of claim 13, wherein, said water-soluble barrier is removed by an ultrasonic water spray.

* * * * *